United States Patent [19]

Röck et al.

[11] 4,176,496

[45] Dec. 4, 1979

[54] GUIDE RAIL ASSEMBLY FOR SLIDING DOORS

[75] Inventors: Erich Röck, Höchst; Bernhard Madges, Dornbirn, both of Austria

[73] Assignee: Julius Blum Gesellschaft M.b.H., Höchst, Austria

[21] Appl. No.: 902,816

[22] Filed: May 4, 1978

[30] Foreign Application Priority Data

May 13, 1977 [AT] Austria ..... 3433/77

[51] Int. Cl.[2] ..... E05D 13/02

[52] U.S. Cl. ..... 49/410; 160/196D

[58] Field of Search ..... 49/410, 409, 411, 412; 60/196–200

[56] References Cited

U.S. PATENT DOCUMENTS

| | | | |
|---|---|---|---|
| 1,109,202 | 9/1914 | Cossey | 49/409 X |
| 1,896,474 | 2/1933 | Anderson | 49/410 |
| 3,601,926 | 8/1971 | Weiher | 49/409 |
| 4,014,070 | 3/1977 | Rifkin | 49/410 X |

FOREIGN PATENT DOCUMENTS

| | | | |
|---|---|---|---|
| 1238497 | 4/1967 | Fed. Rep. of Germany | 49/411 |
| 748641 | 7/1933 | France | 49/411 |
| 902857 | 8/1962 | United Kingdom | 49/409 |

*Primary Examiner*—Philip C. Kannan

*Attorney, Agent, or Firm*—Wenderoth, Lind & Ponack

[57] ABSTRACT

A guide rail assembly for furniture doors includes slide rails fixed to doors, supporting rails fixed to a body and roller-carriers interdisposed between such slide and supporting rails.

7 Claims, 8 Drawing Figures

GUIDE RAIL ASSEMBLY FOR SLIDING DOORS

BACKGROUND OF THE INVENTION

Field of the Invention

The present invention relates to a guide rail assembly for sliding doors, particularly for pieces of furniture, having slide rails fixed to the door or the doors and supporting rails fixed to the body of the piece of furniture, e.g. a top plate, the weight of the door being transmitted from the slide rails onto the supporting rails by means of rollers.

Summary of the Invention

It is a object of the invention to provide a guide rail assembly of relatively simple construction in which expensive structural members, e.g. ball bearings which have to be covered by plastics according to prior art embodiments in order to guarantee smooth running, are no longer necessary and, furthermore, to provide a smoothly and quietly running guide rail assembly.

It is a further object of the invention to provide a guide rail assembly which can easily be adaptive to the various kinds of strain.

According to the invention this is achieved by mounting rollers in at least one roller-carrier disposed between a supporting rail and a slide rail.

A preferred embodiment of the invention provides that plural roller-carriers can be linked to each other, each roller-carrier having, for example, a plug which is inserted into a corresponding aperture of an adjacent roller-carrier.

It is preferably provided that the plugs and apertures are disposed on projections in the front and rear portions of the roller-carrier.

By means of this embodiment it is possible to link the roller-carriers to each other. In a cupboard with two sliding doors, for example, the length of the linked roller-carriers corresponds to one and a half times the width of a sliding door.

The weight of a door does not entirely depend on its width, but its width is generally the essential factor. As a result the loading capacity of the guide rail assembly is adapted to the weight of the door if the linked roller-carriers are adapted to the width of the door.

A further preferred embodiment of the invention provides that the slide rail and the supporting rail have V-shaped profiles, with two flanges extending at an angle of at least about 90°, that the slide rail and the supporting rail are positioned edgewise with respect to the running plane of the guide rail assembly, and that the roller-carrier includes rollers whose rotation axes are staggered to each other by 90°. The profiled flanges of the slide rail and the supporting rail are advantageously inclined to the running plane of the sliding assembly at an angle of about 45°. Due to this position of the supporting rail and the slide rail an exact positioning of the roller-carrier or of the linked roller-carriers, in the supporting rail is obtained and a uniform distribution of forces is the result.

It must also be mentioned that the profiles of the guide rail assembly are made of extruded aluminum. In the case of light doors, profiles made of plastics can also be used.

In order to obtain an exact guiding of the sliding door a preferred embodiment includes a guide rail provided on an end of the piece of furniture opposite the supporting rail and the slide rail 1 guide rollers or slides being mounted on the door and running on such guide rail. Several guide rails can also be provided, their number depending on the number of sliding doors, supporting rails and slide rails.

The slide rails are connected with the door by means of angled braces which can be separate parts being, for example, welded to the slide rails. Slide rails and angled braces can, however, also be made of one profile member, e.g. an extruded profile member.

A further embodiment provides that the supporting rail of a door which is closely adjacent the body is guided on the edge or near to the edge of the body, whereas the supporting rail for another relatively outer sliding door is positioned on the body behind the first supporting rail.

BRIEF DESCRIPTION OF THE DRAWINGS

In the following two embodiments of the invention will be described in more detail, with reference to the attached drawings without being limited thereto, and wherein.

DESCRIPTION OF THE PREFERRED EMBODIMENTS

Figure 4:
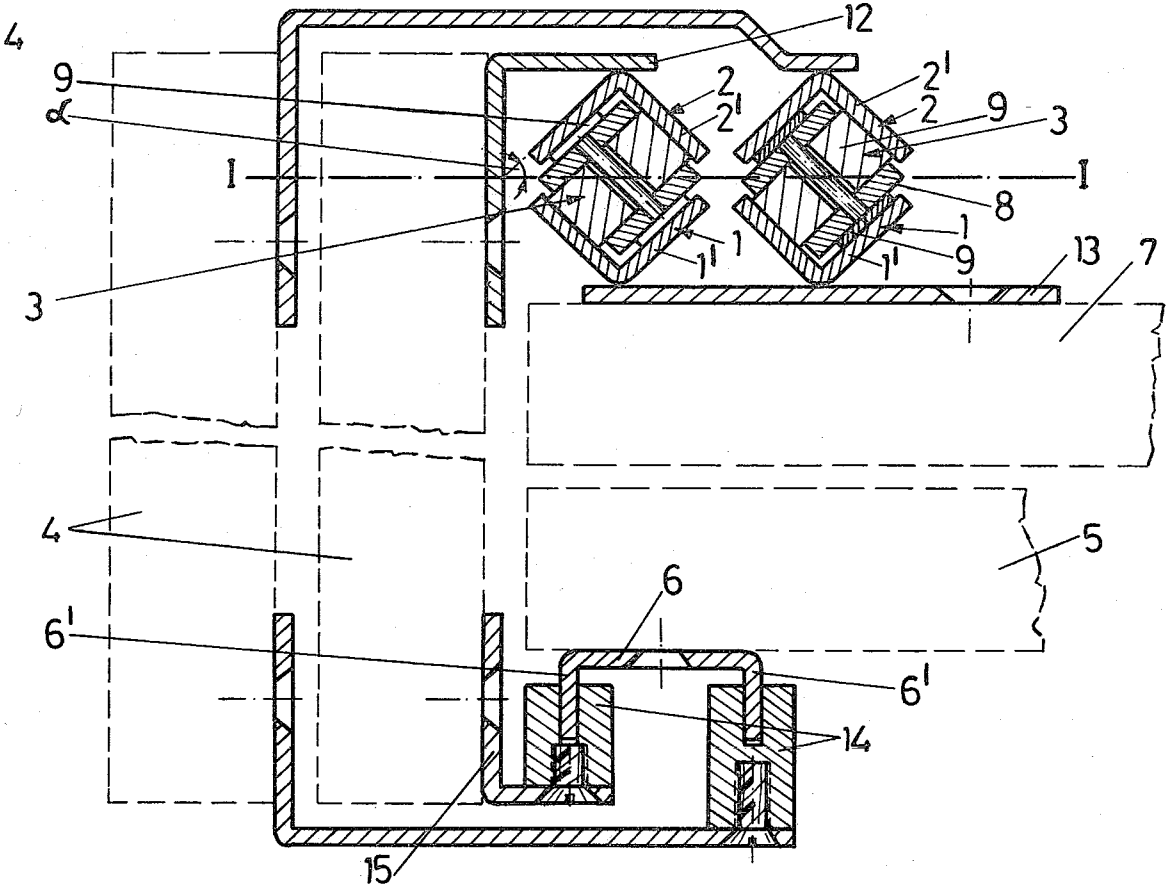
FIG. 4 is a vertical section of the individual parts of the guide rail assembly.

As can particularly be seen in FIG. 4, the guide rail assembly according to the invention substantially comprises the supporting rails 1, the slide rails 2 and the roller-carrier assemblies 3. According to this embodiment the slide rails, supporting rails and roller-carrier assemblies are disposed on the top plate and on the outer side, or front of the piece of furniture.

In order to obtain satisfactory guiding of the sliding doors 4, a guide rail 6 is provided on the bottom plate and also on the outer side, or front, of the piece of furniture, guide rail 6 having two vertical flanges 6', each of which is a guiding device for the sliding door 4.

The supporting rail 1 and the slide rail 2 are positioned edgewise, so that their flanges 2', 1' are positioned at an angle $\alpha$ of 45° with respect to a plane I—I which is in the direction of movement of the sliding doors 4.

Figure 5:
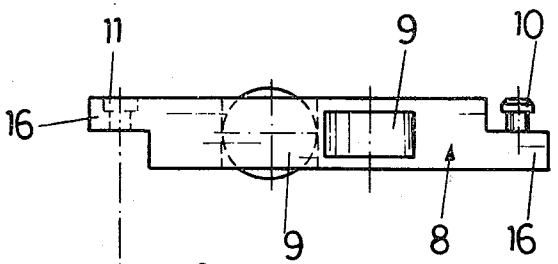
FIG. 5 is a side view of a roller-carrier.

The plane I—I extends at a right angle to the alignment of the sliding doors 4 and parallel with respect to the top plate 7 of the piece of furniture. Assemblies 3 include roller-carriers 8 which are disposed between the supporting rails 1 and the slide rails 2, such carriers supporting roller 9. According to the illustrated embodiment each roller-carrier 8 carries two rollers 9 whose rotation axes are staggered with respect to each other by 90° (FIG. 5).

Figure 1:
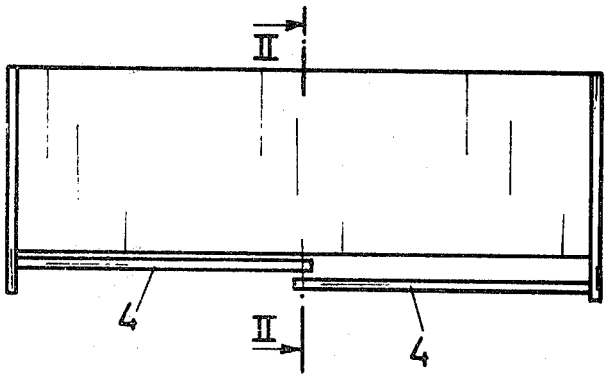
FIG. 1 is a schematic view of a cupboard-like piece of furniture with sliding doors.
Figure 2:
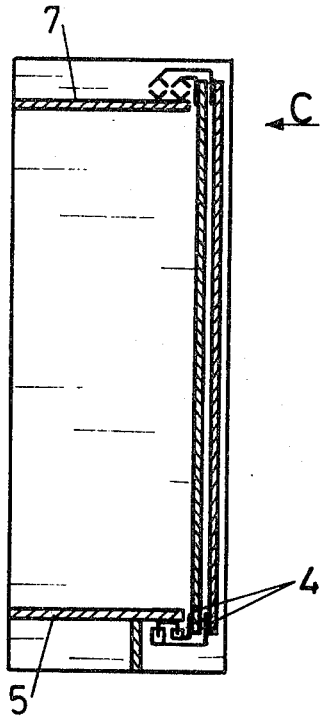
FIG. 2 is a section along line II—II of FIG. 1.
Figure 3:
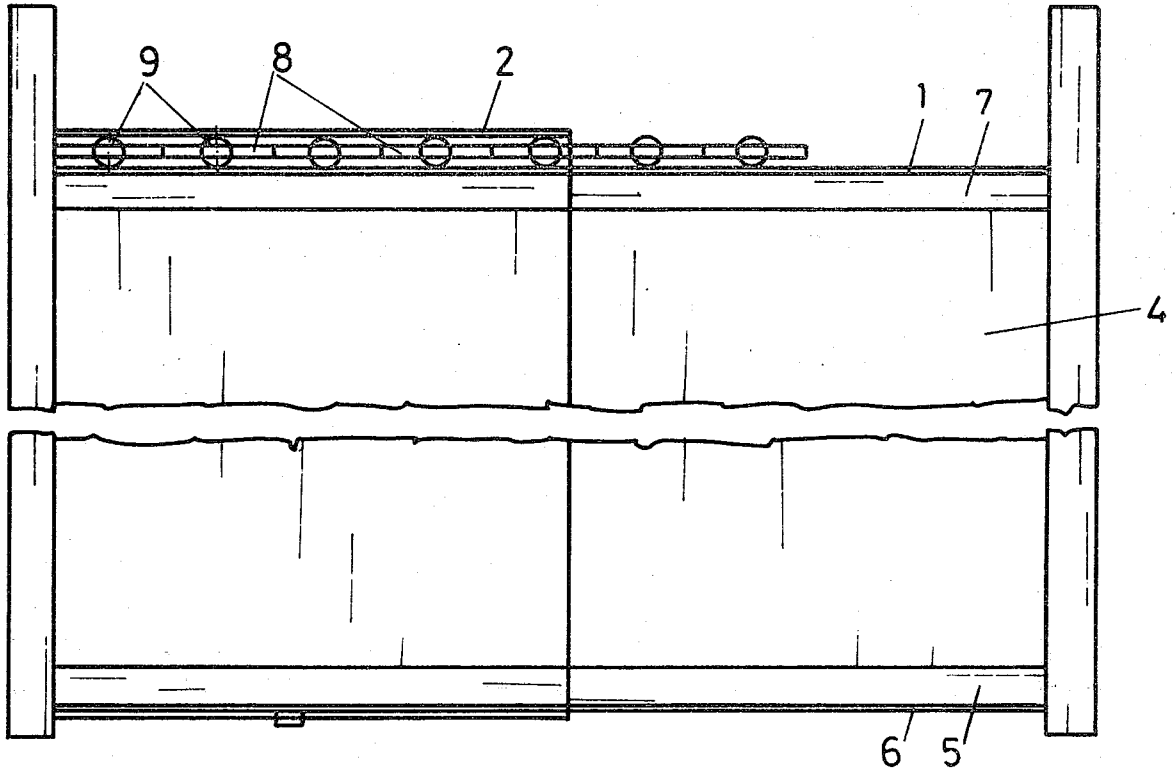
FIG. 3 is a schematic view in the direction of arrow C of FIG. 2.
Figure 6:
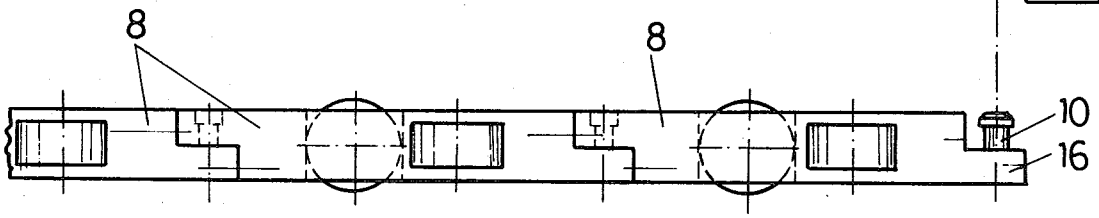
FIG. 6 is a side view of linked roller-carriers.
Figure 7:
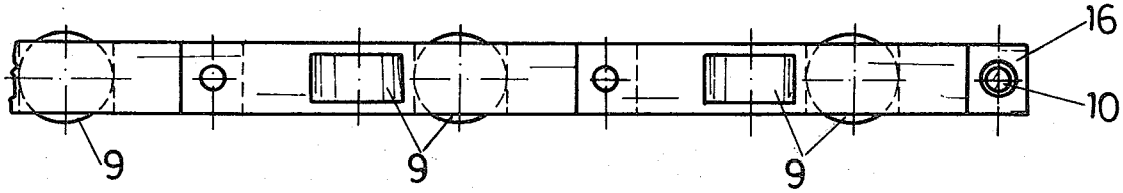
FIG. 7 is a view similar to FIG. 6, but shifted by 90°.

As can be seen in FIGS. 6 and 7, roller-carriers 8 are linked to each other, and have projections or plugs 10 for this purpose to be inserted into corresponding apertures 11 of the adjacent roller-carriers 8. The length of the linked roller-carriers can be seen in FIG. 3, the difference between the length of the supporting rail 1 and the length of the linked roller-carriers corresponding to at least half the length of the path of the sliding door 4 in order to guarantee differential running. The plugs 10 and apertures 11 are disposed on projectons 16 on the front and rear of the roller-carriers 8.

FIG. 4 illustrates how the rollers 9 which are staggered with respect to each other by an angle of 90°, rest against the flanges 1' and 2' of the supporting rails and slide rails, respectively, whereby this embodiment provides that the roller of each row of rollers which have parallel rotation axes carry half the weight of the sliding door 4.

In the embodiment according to FIG. 4 the supporting rails 1 are connected with the sliding doors 4 by means of separate angled braces 12, and slide rails are connected to top plate 7 by means of a top rail plate 13. It is possible, however, to form the profile of the rails in such a way that the supporting rails 1 and braces 12 and the slide rails 2 and rail plate 13, are each formed in one piece.

Figure 8:
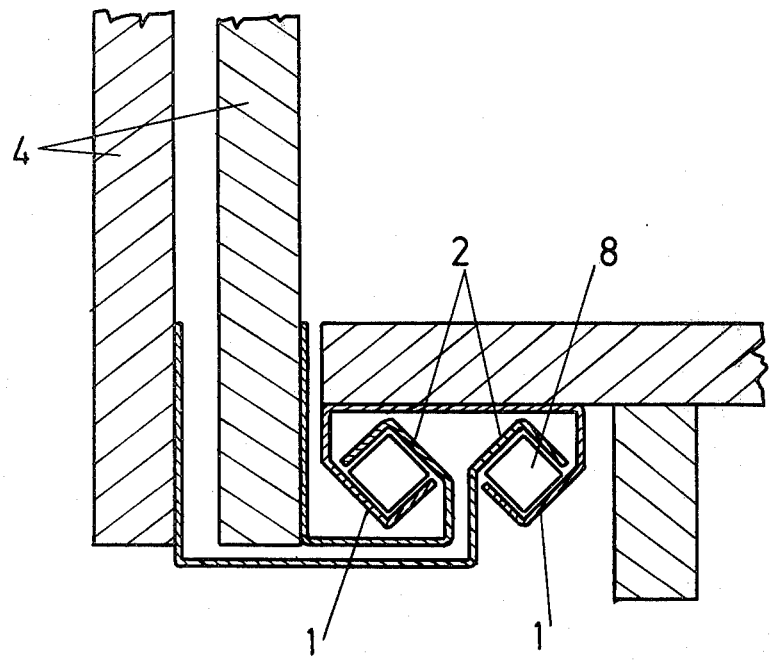
FIG. 8 is a vertical section of the supporting rail and the slide rail of a second embodiment of the invention.

Such an embodiment is illustrated in FIG. 8. According to this embodiment the supporting rails 1 and the slide rails 2 are not disposed on the top plate 7, but rather are provided below the bottom plate 5. Thus, the sliding doors 4 press against the guide rail assembly. According to this embodiment the actual guide rail (rail 6 in FIG. 4) is fastened on the top plate 7, but is not illustrated in FIG. 8 as it entirely corresponds to the structure shown in FIG. 4.

As can also be seen in FIG. 4, slides 14 are connected with the sliding doors 4 by means of braces 15 and run on vertical flanges 6' of the guide rail 6.

What is claimed is:

1. A guide rail assembly for sliding doors, particularly sliding doors on pieces of furniture, said guide rail assembly comprising:

an elongated supporting rail for each sliding door and adapted to be fixed to a body of a piece of furniture, said supporting rail having a V-shaped profile defined by first and second elongated flanges extending at an angle of approximately 90° with respect to each other;

an elongated slide rail for each sliding door and adapted to be fixed to such sliding door, said slide rail having a V-shaped profile defined by first and second elongated flanges extending at an angle of approximately 90° with respect to each other;

an elongated roller-carrier assembly for each sliding door, said roller-carrier assembly including first and second groups of rollers, each said roller having a cylindrical surface defined about an axis of rotation, the axes of rotation of all of said rollers of each said group of rollers being parallel, said axes of rotation of said rollers of said first group extending substantially orthogonally to said axes of rotation of said rollers of said second group;

said roller-carrier assembly being loosely positioned between said supporting rail and said slide rail such that said cylindrical surfaces of said rollers of said first group are in rolling contact with said first flange of said supporting rail and said second flange of said slide rail, and said cylindrical surfaces of said rollers of said second group are in rolling contact with said second flange of said supporting rail and said first flange of said slide rail; and means for attaching said supporting rail to the body of the piece of furniture, and means for attaching said slide rail to the sliding door, such that said first and second flanges of said supporting rail and said first and second flanges of said slide rail extend at angles of approximately 45° to a plane which extends in the direction of movement of the sliding door and substantially transverse to the sliding door.

2. An assembly as claimed in claim 1, wherein said roller-carrier assembly comprises plural elongated roller-carriers which are connected in an end-to-end manner.

3. An assembly as claimed in claim 2, wherein each said roller-carrier has a plug inserted into a corresponding aperture of an adjacent roller-carrier.

4. An assembly as claimed in claim 3, wherein each said roller-carrier has at a first end thereof a first projection having said plug and at a second end thereof a second projection having said aperture.

5. An assembly as claimed in claim 1, further comprising a guide rail adapted to be fixed to the body of the piece of furniture at a position opposite said supporting rail and said slide rail, and a slide for each sliding door and adapted to be fixed to such sliding door, said slide sliding along said guide rail.

6. An assembly as claimed in claim 5, further comprising angled braces for connecting said slide to the sliding door.

7. An assembly as claimed in claim 1, adapted for use with a piece of furniture including a first sliding door positioned relatively close to the piece of furniture and a second sliding door positioned relatively spaced from the piece of furniture, said assembly including a first said supporting rail for use with the first sliding door and a second said supporting rail for use with the second sliding door, said first supporting rail adapted to be positioned adjacent an edge of the piece of furniture confronting the sliding doors, and said second supporting rail adapted to be positioned on the piece of furniture at a location further spaced from said edge than said first supporting rail.

* * * * *